US006000219A

United States Patent [19]

Mies

[11] Patent Number: 6,000,219

[45] Date of Patent: Dec. 14, 1999

[54] CHARGING VALVE ARRANGEMENT TO CHARGE A STORE

[75] Inventor: Hubertus Mies, Lohr/Main, Germany

[73] Assignee: Mannessmann Rexroth GmbH, Germany

[21] Appl. No.: 08/952,712

[22] PCT Filed: Mar. 21, 1996

[86] PCT No.: PCT/EP96/01245

§ 371 Date: Mar. 3, 1998

§ 102(e) Date: Mar. 3, 1998

[87] PCT Pub. No.: WO96/33346

PCT Pub. Date: Oct. 24, 1996

[30] Foreign Application Priority Data

Apr. 21, 1995 [DE] Germany ..... 195 14 745

[51] Int. Cl.[6] ..... F15B 1/027

[52] U.S. Cl. ..... 60/418; 60/422; 60/452

[58] Field of Search ..... 60/418, 422, 452

[56] References Cited

U.S. PATENT DOCUMENTS

| | | | |
|---|---|---|---|
| 2,799,995 | 7/1957 | Herman | 60/418 |
| 4,252,141 | 2/1981 | Burgdorf et al. | 60/418 |
| 4,337,620 | 7/1982 | Johnson | 60/418 |
| 4,819,430 | 4/1989 | Becker | 60/422 |

FOREIGN PATENT DOCUMENTS

| | | |
|---|---|---|
| 215129 | 5/1983 | Germany . |
| 3327978 | 2/1985 | Germany . |
| 3426354 | 1/1986 | Germany . |
| 3501660 | 7/1986 | Germany . |
| 8533311 | 12/1986 | Germany . |
| 3034467 | 10/1991 | Germany . |
| 9200009 | 7/1992 | Germany . |

OTHER PUBLICATIONS

Hydraulik in Werkzeugmaschinen, A. Dür und O. Wachter, 1968, pp. 124–125.

Grundlagen der hydraulischen Schaltungstechnik, 1994, pp. 88, 90, 93 & 94.

*Primary Examiner*—F. Daniel Lopez

*Attorney, Agent, or Firm*—Mayer, Brown & Platt

[57] ABSTRACT

A load valve apparatus having a control valve which can be connected to a pump and an accumulator and which in a first position connects the pump to the accumulator and in a second position isolates the pump from the accumulator, and the pump and the accumulator are isolated from one another when the accumulator pressure exceeds a certain value, and a connected consuming device is isolated from the accumulator in such a way that the load pressure of the consuming device does not affect the accumulator. The pressure of the pump and/or of the accumulator is used to regulate the pump.

16 Claims, 5 Drawing Sheets

CHARGING VALVE ARRANGEMENT TO CHARGE A STORE

FIELD OF THE INVENTION

The invention relates to a load valve apparatus for loading an accumulator. Generic loader valves are used, for example, to load hydraulic accumulators with hydraulic fluid.

BACKGROUND OF THE INVENTION

FIG. 5 shows a circuit diagram of a conventional valve apparatus used as a load valve for loading an accumulator. The reference character S indicates the hydraulic accumulator, which is supplied with hydraulic fluid via a restrictor D and a check valve RV. Reference character N indicates a consuming unit which can be supplied with hydraulic fluid via a control valve SV. In addition, hydraulic pressure is applied to the control line SL via the restrictor D and the regulating valve REV. The regulating valve REV is "tensioned" by the hydraulic pressure in the control line SL. The regulating valve REV has three positions, A, B, and C. In FIG. 5, the regulating valve REV is shown in position A. In position A, the hydraulic pressure is applied from pump P to control line SL via the restrictor D. In position B, all ports of the regulating valve REV are closed off, and in position C the control line is discharged into tank T.

As indicated in FIG. 5, the regulating valve is tensioned on both sides by the hydraulic pressure in the control line SL; plunger K1 (on the right side in FIG. 5), which tries to force the regulating valve REV into discharge position C, has a smaller area than the opposing plunger K2. A further plunger K3, to which the pressure of the accumulator S is applied, acts on the right side of the regulating valve REV. Plunger K3 also tries to force the regulating valve into discharge position C. A spring F on the left side of the regulating valve opposes plunger K3 and plunger K1, and spring F is assisted by plunger K2. The pressure line SiV on the left of the selector valve serves as the signal pressure line of the consuming device V.

The loading procedure for the accumulator S is described below. The control valve SV is only used to control hydraulic flow to the consuming device N and has no effect on the loading procedure. The control valve SV is closed during the loading procedure and therefore has no function with respect to the loading procedure.

During the loading procedure, plunger K2 balances out the load applied by plunger K3. Thus only plunger K1 opposes spring F. At the end of the loading procedure, plungers K1 and K2 are released; and plunger K3 then suddenly acts on spring F, leading to an abrupt control movement (load, deflection or hysteresis). If the accumulator S is empty or mostly empty, the regulating valve REV is in position A as shown. The accumulator V is loaded "slowly" in this position via the restrictor D and the check valve RV. If the accumulator S reaches a given pressure, plunger K1 forces the regulating valve REV into position B. As already explained, plungers K2 and K3 balance out each other's load during the loading procedure, such that the regulating valve REV is forced into position B. As a result, the dynamics of the system create an intermediate position A/B. When the pressure line is discharged into tank T, the pressure in plungers K1 and K2 drops to the level in the tank. As a result, only plunger K3 continues to have an effect. The abrupt change in load on the plunger results in an abrupt change in the deflection of the plunger, with approximately 18% hysteresis.

The pressure level at which the regulating valve is moved can be set via spring F. In position B, the pressure which has already built up in the control line SL is held, and the pump supplies further hydraulic fluid. If the pressure in accumulator S increases further, the regulating valve REV is forced into position C. In this position, the pressure from the control line is released into the tank. When the pressure in the control line drops abruptly, pump P receives a signal to go to idle if the loading pressure is the highest pressure in the load valve apparatus.

If the pressure in accumulator S drops, the reverse takes place. The regulating valve is forced back into position C by spring F. In this position, pressure can once again build up in the control line SL, since the pump is operating at idle. Once the pressure reaches a certain level, a signal is sent to the pump to increase its pumping rate to full. A short circuit at the regulating valve causes deactivation of the pump; otherwise, the pressure rises until the delta P of the regulating valve for a pumping rate greater than zero is reached. This loading apparatus has certain disadvantages, however. The accumulator S continues to be loaded until the pump P is deactivated. If consuming devices in V are loaded to a pressure that is higher than the deactivation pressure of the load valve apparatus, the accumulators will be loaded up to that pressure. If the load pressure exceeds the maximum permitted accumulator pressure, the accumulator S or the valve will be overloaded.

The object of the invention is to produce a load valve apparatus which keeps the accumulator S and the valve (whose housing is generally made of grade GG 30 gray cast iron) from overloading.

SUMMARY OF THE INVENTION

The object is achieved via the characteristics of the present invention which achieve the following: When a given limit pressure is reached, the accumulator is isolated from the pump. This keeps the accumulator from being overloaded by the pump in all situations. In addition, the load pressure of the consuming device cannot act on the accumulator. This results in a load valve apparatus which protects the accumulator and prevents overloading of the accumulator and of the valve itself.

The pump can be controlled via a control line. The pressure in the control line is regulated by a regulating valve having a discharge position. In this position, the control line is released into a tank. As a result, the pressure in the control line drops and the pump receives a corresponding signal to go to idle if the load pressure or the accumulator pressure is the highest pressure in the system at that moment.

The regulating valve can be placed in an additional intermediate position. In this position, the control line is released into a tank across a restrictor. This ensures a more continuous control process. Thus the regulating valve can ensure that the load pressure in the valve is limited to a specific value.

The regulating valve is preferably controlled by the accumulator pressure and in the idling position the accumulator pressure is opposed by the force of a spring. During loading, the load flow rate increases. The regulating valve can therefore be tensioned by means of the control pressure, and tensioning is carried out in such a way that the spring is assisted.

The control line is connected either to the accumulator or to the pump and fluid is preferably supplied to the control line via a restrictor.

The main valve which connects the accumulator to the pump or interrupts this connection is controlled via the accumulator pressure. The force of a spring may act against the accumulator pressure. The spring may also be assisted by the control pressure in the control line.

The pump can be controlled directly by the control line. Alternatively, a control valve can be controlled via the control line, and when the pressure drops in the control line the control valve is forced into a discharge position. In this discharge position, the line connected to the pump to control the pump is discharged, and the pump is thus controlled indirectly via the control line. If the accumulator pressure is used to control the pump directly, selector valve failure unavoidably results in an accumulator circuit failure and, consequently, a brake circuit failure.

The load valve apparatus of the invention makes loading problem-free even in the case of very high pressures, and the system can be deactivated in any situation in which the accumulators are loaded. In addition, the load time is shorter, because delta $P=P_{pump}-P_{accumulator}$ is large (as explained with reference to the typical embodiment). Moreover, loading is completely reliable in instances where the pressure of multiple consuming devices is greater than the accumulator pressure (as explained with reference to the typical embodiment). This prevents the risk of the accumulator or the load valve being destroyed.

One can produce a particularly compact load valve apparatus if the valve for isolating the accumulator and a part of the control line having a restrictor are combined within a single housing. The advantage is that there is no high pressure in the housing. An integrated load valve of this kind is shown in detail in FIG. 4.

The invention is described below with reference to various typical embodiments.

The invention is explained in more detail in the following using the preferred exemplary embodiments and referencing the accompanying drawings.

Figure 1:
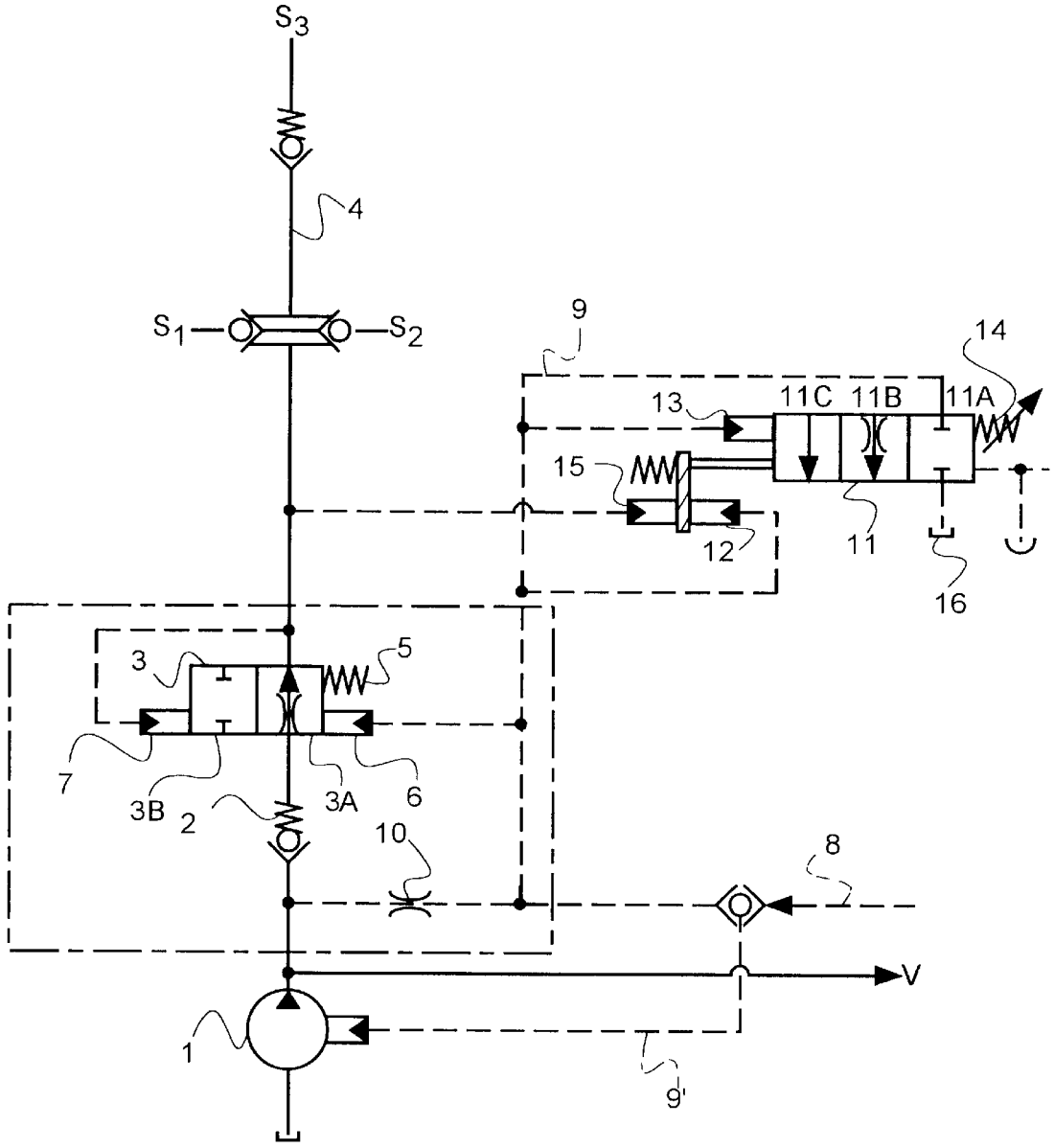
FIG. 1 shows the circuit diagram for a first typical embodiment.

Below, we describe the invention with reference to FIG. 1. A pump 1 pumps hydraulic fluid into an accumulator 4 via a check valve 2 and a control valve 3 when the control valve 3 is in the open position 3A. However, the check valve is not absolutely necessary. Nevertheless, if a check valve is used, this provides additional security in the event of failure of the pump drive mechanism or of a closed-off pump line or consuming device. A further line leads from the pump 1 to consuming devices V. The load signal from these consuming devices is conveyed via a line 8, which is shown to the right of the selector valve.

When a specific limit pressure is reached in an accumulator 4, the control valve 3 is moved to closed-off position 3B by means of a plunger 7 (which is opposed by a spring 5). This disconnects the accumulator from the pump 1 and the consuming unit.

As shown in FIG. 1, in this typical embodiment the spring 5 is assisted by a plunger 6 controlled by the control line 9. The functioning of the regulating valve 11 and the raising/lowering of pressure in a control line 9 is explained below.

When the accumulator 4 is being loaded, the pump 1 also pumps fluid into the control line 9 via a restrictor 10. This tensions a regulating valve 11 in the manner shown, such that the regulating valve 11 is forced into position 11B during loading. The surface area of a right plunger 12 is greater than that of a left plunger 13. As a result, the pressure in the control line 9 assists the spring 14, which forces the regulating valve 11 into the closed-off position 11A shown. The regulating valve 11 will be in this position when the accumulator 4 is loaded. It should be noted that the circuit diagram does not show any direct connection between plungers 12 and 15 and the switch plunger of the regulating valve 11. Basically the connection can be established directly or indirectly. The plunger 13 is connected to the switch plunger directly. Plungers 12 and 15 oppose each other, and the spring shown on the plunger 15 is merely an auxiliary spring and is not a significant load.

The load pressure $P_{LS}$ increases until the plunger 13 forces the switch plunger of the regulating valve 11 into position 11B, thereby keeping the load pressure constant during loading. The plungers 12 and 15 act on the switch plunger at the end of the loading procedure. The small auxiliary spring merely causes a displacement to keep a stop disc between the plungers from coming loose.

The spring 14 is opposed by a plunger 15. The accumulator pressure is applied to the plunger 15, and the plunger 15 tries to force the regulating valve 11 into the discharge position 11C. An intermediate position 11B is provided between the closed-off position 11A and the discharge position 11C. In this intermediate position, the control line is discharged (with restricted flow) into a tank 16.

The control line 9 is connected via the line section 9' to the pump 1 and the pump regulator, which is controlled by means of the pressure in the line section 9'. If this pressure is high, the pump works at full delta P. The pressure then drops dramatically, and the pump goes to idle. If the pressure is $P_{LS}=0$, the pump regulates the "resting pressure" of the system; if $P_{LS}>0$, the pump regulates the operating pressure and the delta P.

In the position for loading the accumulator shown in FIG. 1, the control line 9 is closed off by the regulating valve 11. As a result, high pressure is built up in the control line 9 by the pump 1. If the accumulator pressure exceeds a given limit value, the plunger 13 forces the regulating valve 11 into discharge position 11C against the load of spring 14 and the difference between the loads of plungers 15 and 12. In discharge position 11C, the control line is discharged into the tank 16, the pressure in the control line 9 and the line section 9' drops dramatically, and the pump 1 goes to idle accordingly.

As long as the accumulator pressure does not drop and the control valve 3 does not switch back to the open position 3A, the pump pumps at idle via the regulating valve 11 into the tank 16. If the accumulator pressure does drop, a sudden load on the switch plunger causes the regulating valve to jump back to the closed-off position 11A via the restricted position 11B. After a given pressure has built up, the regulating valve is forced into position 11B. In this position it regulates the build-up of pressure: As soon as the pump pressure is greater than the accumulator pressure, the pump pumps fluid into the accumulator. The pump rate is a function of the difference in pressure $P_{pump}-P_{accumulator}$. The pump pressure increases to $P_{LS}$+delta $P_{regulator}$.

In the following explanation, we essentially address the ways in which the further typical embodiments differ from the first typical embodiment. We have not provided a detailed explanation of the ways in which the further typical embodiments resemble the first typical embodiment.

Figure 2:
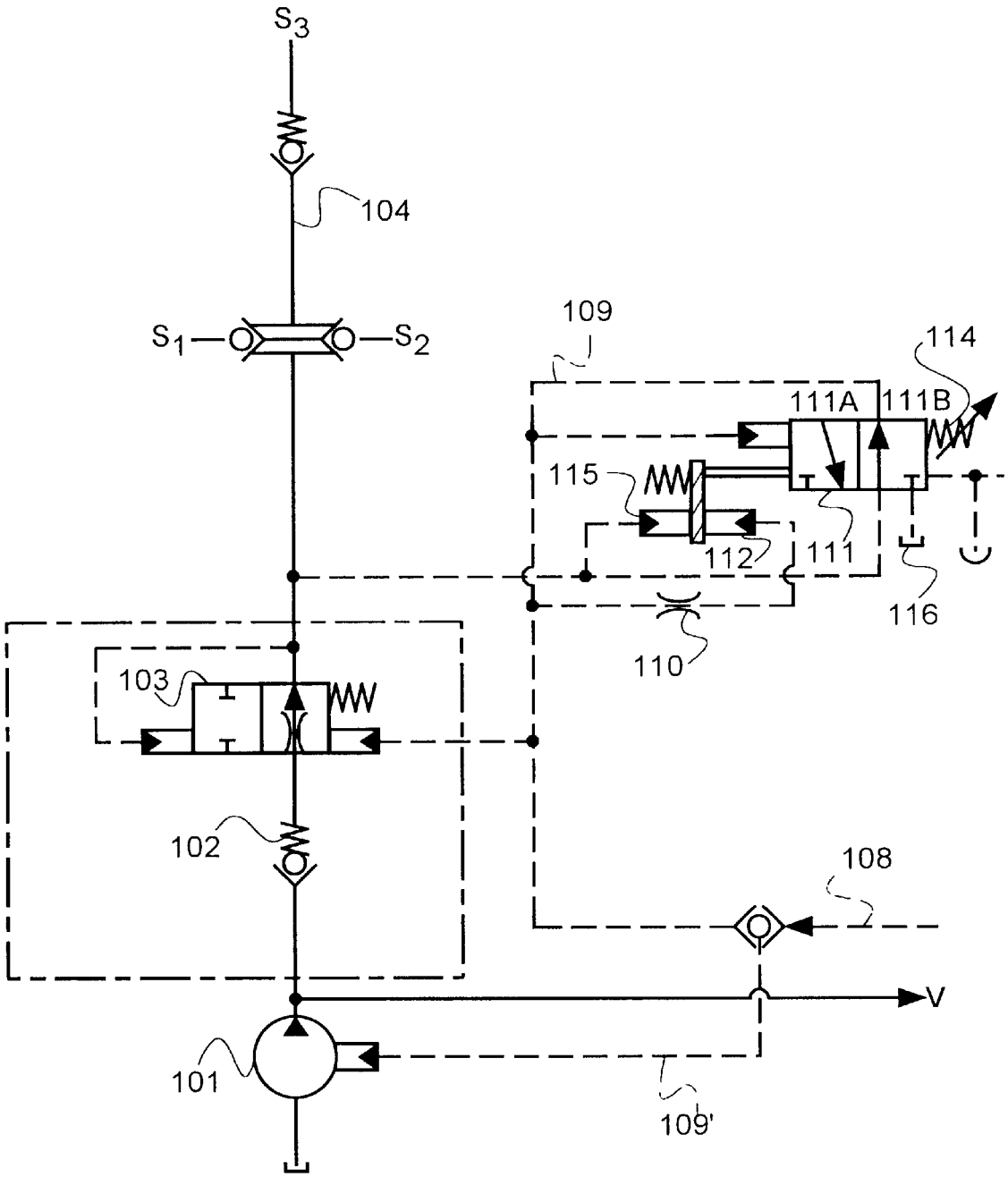
FIG. 2 shows the circuit diagram for a second typical embodiment.

In a typical embodiment in FIG. 2, the control valve 103 is arranged in the same way as in the first typical embodiment. It also functions in exactly the same way. However, in contrast with the first typical embodiment, the control line 109 is not supplied with fluid by the pump 101 but rather by the accumulator 104. As shown in FIG. 2, the accumulator pressure is applied to the control line 109 and thus to the line section 109' of the pump regulator via a restrictor 110 and the regulating valve 111A. The restrictor 110 is not absolutely necessary and may be left out.

As is the case in the first typical embodiment, when the accumulator pressure reaches a certain value, the regulating valve 111 is forced from position 111A (which allows pressure to build up in the control line 109) into the discharge position 111B. In the discharge position, the control line 109 is discharged into the tank 116. As a result, the pressure in the line section 109' drops dramatically, and the pump 101 goes to idle. As soon as the accumulator pressure falls below a pre-assigned value, the valves return to the positions shown. Since the pump 101 is operating at idle, pressure can build up in the control line and as a result the pump is switched to full delivery rate again. In this typical embodiment, the control valve 103 isolates the accumulator 104 from the pump 101 and the consuming unit. The advantage of this is that there is no load flow.

Figure 3:
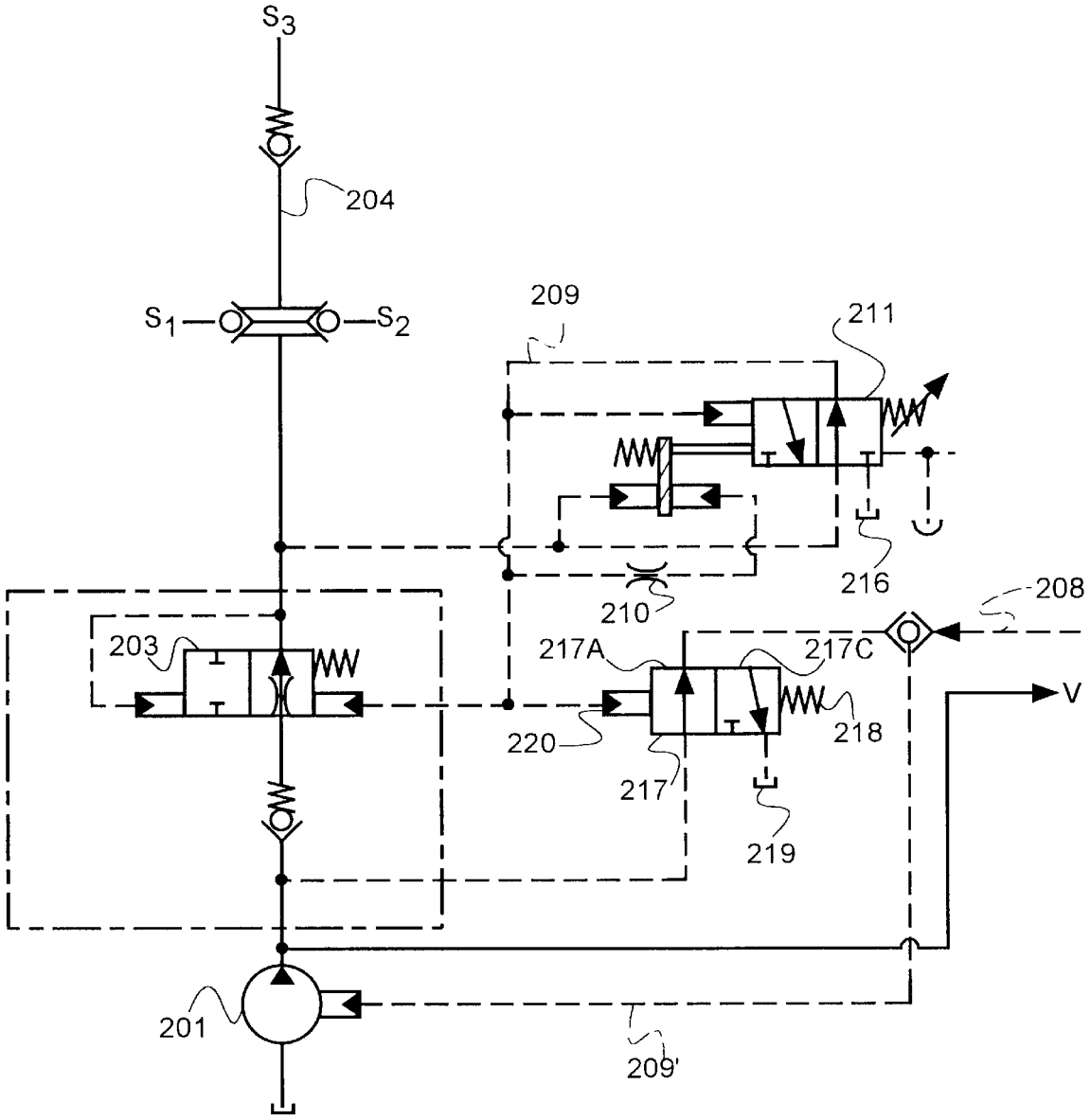
FIG. 3 shows the circuit diagram for a third typical embodiment.

A third typical embodiment is shown in FIG. 3 and differs from the second typical embodiment in the following respects only. The pump regulator having the line section 209' is not controlled directly via the pressure in the control line 209. Instead, an additional valve is controlled by means of the pressure in the control line 209. When the pressure in the control line 209 drops dramatically, the additional valve releases the pressure in the line section 209' and the pump regulator, thereby switching the pump 201 to idle. The advantage of this design is that there is no load flow. In addition, the absence of the load flow line has no effect on the accumulator(s).

The additional valve 217 shown has a restricted open position 217A and a discharge position 217C. If, as in typical embodiment 2, the regulating valve 211 is forced into the discharge position due to high accumulator pressure, the additional valve 217 is forced into the discharge position 217C by the load of spring 210, and the line section 209' is discharged into a tank 219. Accordingly, the pump 201 is switched to idle.

If the accumulator pressure falls, the regulating valve 211 returns to the open position 211A shown, and pressure can once again build up in the control line 209. This build-up in pressure first pushes the additional valve 217 into the middle position 217A via the plunger 220 and against the load of spring 218. In this position, pressure can once again build up in the line section 209', which then switches the pump to full pump rate again. In this typical embodiment, the accumulator 204 is protected by the additional valve 217. This permits higher pump pressure, $P_{pump}$. The pump pressure is a function of the pressure of the consuming unit, $P_{cons}$.

Figure 4:
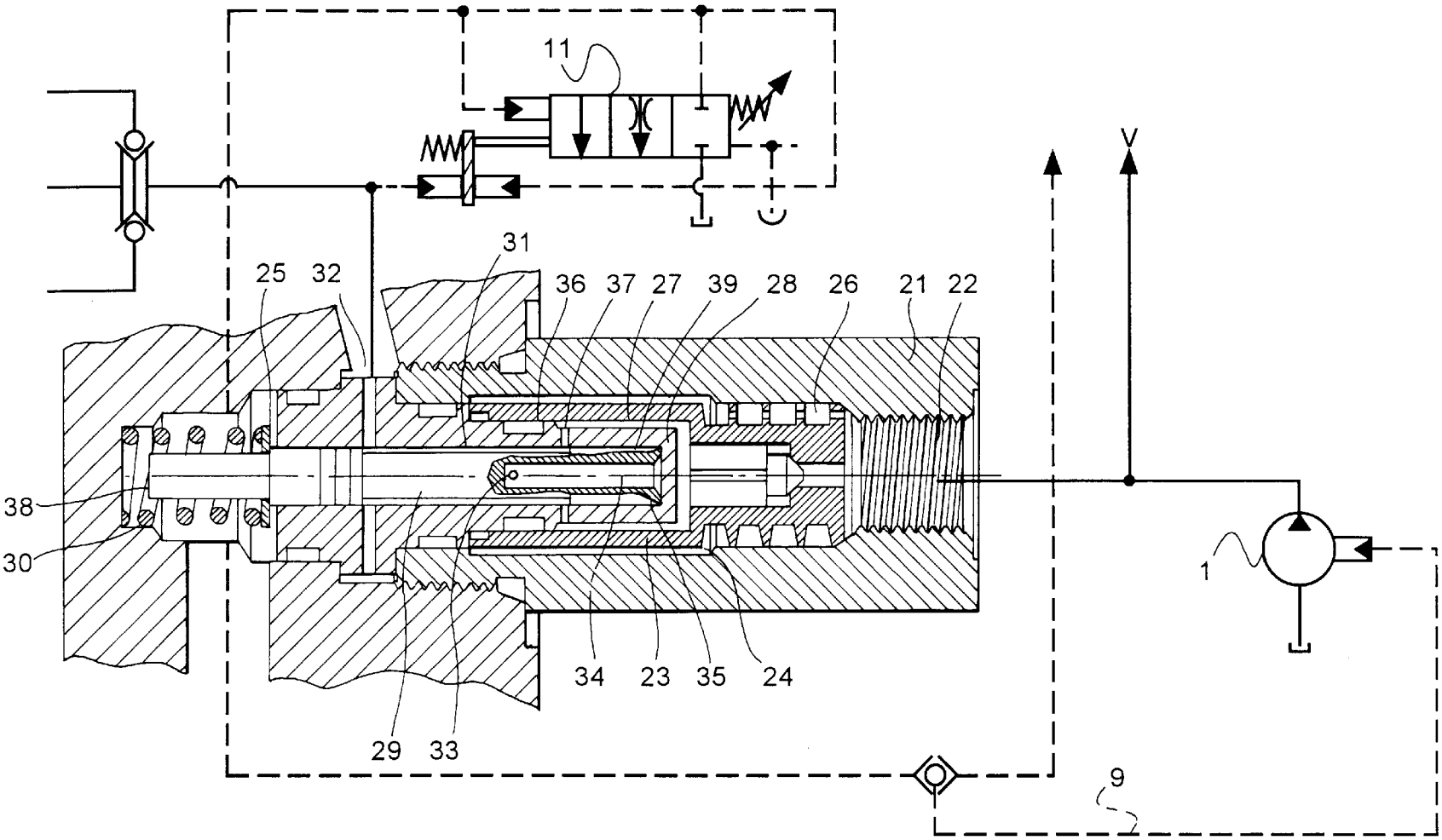
FIG. 4 shows the cross-section of the integrated load valve of FIG. 1.
Figure 5:
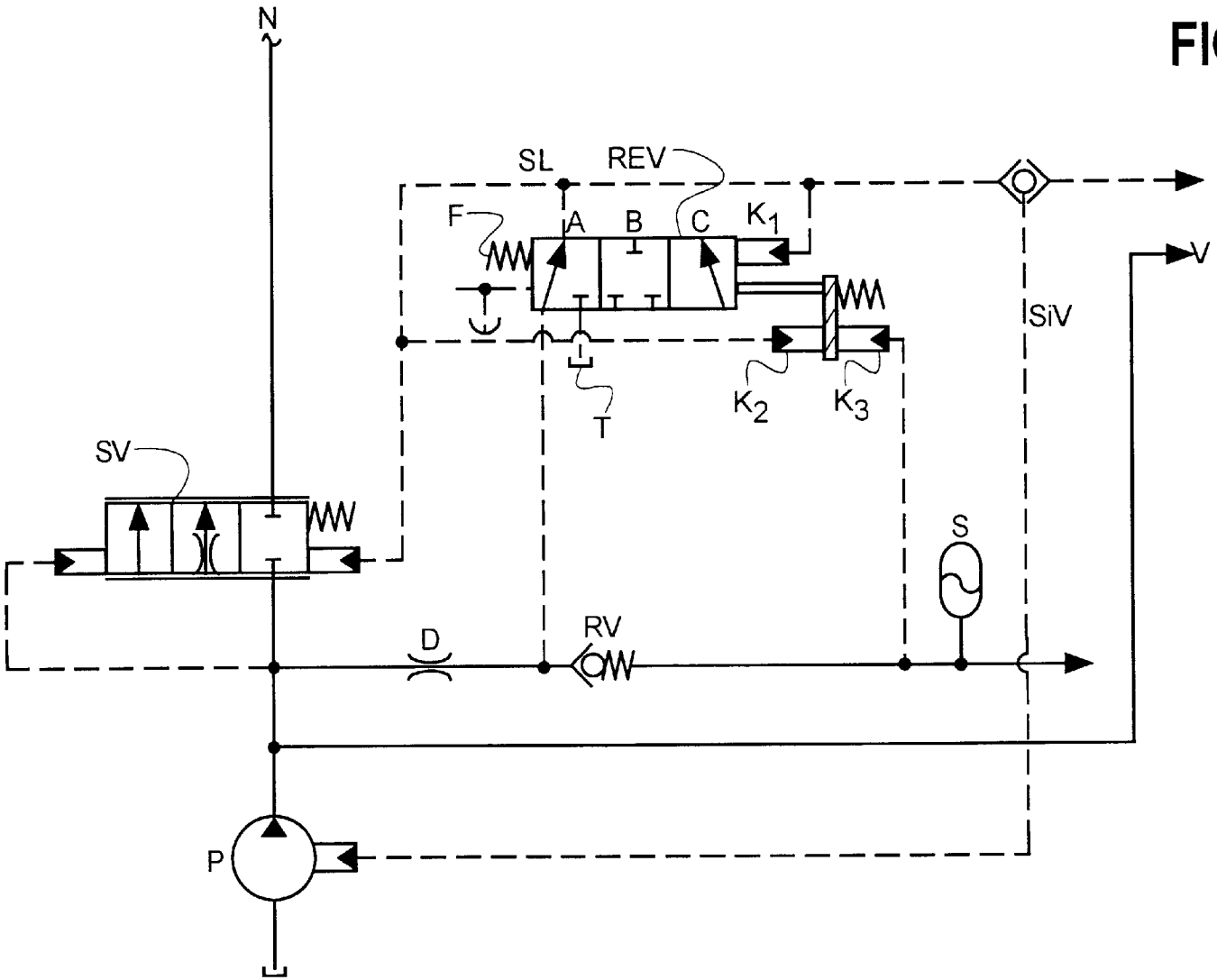
FIG. 5 shows the circuit diagram for a prior art loading system.

FIG. 4 shows an integrated load valve for which the circuit shown in FIG. 1 is used. In this load valve, the control valve and a part of the control line having a restrictor are integrated.

The load valve has an outer housing component 21 having a central inlet 22 to which the pump is connected. An outer control channel 24 on the circumference of a contained casing 23 leads from this inlet 22 via a series of restrictors 26 to the end of the load valve opposite the outlet 25. The outlet 25 connected to the control channel 24 can be connected to the control line and to the regulating valve 11 as shown. Four pockets are provided as a series of restrictors 26 in the front part of the control channel and embody a restrictor in the control channel 24. A second channel 27 passes along the central axis of the casing 23 (possibly via a check valve) and then along the inner circumference of the casing between the casing 23 and a cylindrical component 28.

A plunger 29 is provided inside the cylindrical component 28 and can be moved back and forth. The plunger is opposed (in the direction of the inlet 22) by a spring 30 on the side of the outlet 25. The plunger 29 is shown in its right-hand end position. When the plunger is in this position, the fluid in the channel 27 is conveyed via holes 37 in the cylindrical component 28 to grooves 31 on the circumference of the plunger 29 and via these grooves 31 to the accumulator outlet 32. As shown, the accumulator outlet 32 is connected to the fluid reservoir (not shown) and to the regulating valve 11 for the purpose of controlling the regulating valve 11.

The grooves 31 do not extend along the entire length of the plunger 29. They only extend along the area of the plunger 29 indicated in FIG. 4. This means that when the plunger 29 is in the end position (as shown) the grooves 31 extend from the radially inward-pointing connecting section 37 of the channel 27 as far as the accumulator outlet 32. This creates a connection between the channel 27 and the accumulator 32 whenever the plunger is in this position. In addition, the grooves 31 are connected with a space 35 in the base of the plunger 29 via holes 33 and 34. The housing part 21, the casing 23 and the cylindrical component 28 are sealed off from one another by means of seals 36.

Below, we describe the functioning of the load valve. When the accumulator is being loaded, the plunger 29 is in the position shown. The fluid flows via the inlet 22 and the channel 27 and via the grooves 31 of the plunger 29 and via the accumulator outlet 32 to the accumulator and to the regulating valve 11.

At the same time, the fluid flows under restricted conditions via the series of restrictors 26 and the control channel 24 to the outlet 25. Since the regulating valve 11 is in the closed-off position 11A during the load procedure, pressure is present in the control line, and the pump pumps accordingly. In position 11B, the plunger limits the pressure. If the pressure in the accumulator rises, the pressure in the grooves 31 also rises, causing the pressure in the space 35 in the base of the plunger to rise too.

During loading, the accumulator pressure is lower than the load pressure Ls. At the end of loading, the accumulator pressure is almost as great as the load pressure. Since the spring is very powerful, the plunger closes, thereby discharging the Ls line into the tank 16. The spring guarantees protection even in the case of contaminated oil. The plunger prevents loading of the accumulator(s) if the pressure, $P_V$ rises. Deactivation of the control valve 3 is controlled by the regulating valve 11 alone.

The procedure already explained with reference to FIG. 1 is carried out in the above manner. Furthermore, if the control line is discharged via the regulating valve 11, the pressure on the rear end of the plunger 38 also drops and the plunger 29 does not return to the position shown immediately if there is a slight drop in the accumulator pressure. Instead, it remains in the closed-off position for a longer period, until the accumulator pressure drops below a minimum pressure pre-assigned by the load of the spring 30.

Only then does the plunger 29 return to the through-flow position, and at the same time switches the regulating valve 11 back. As a result, pressure can once again build up in the control line since the pump is pumping at idle. The pump is then switched back to the full pump rate.

What is claimed is:

1. A load valve apparatus comprising:

a control valve (3, 103, 203) which is connected to a pump (1, 101, 201) having a pump pressure and an accumulator (4, 104, 204) and which in a first position connects the pump (1, 101, 201) to the accumulator (4, 104, 204) and in a second position separates the pump (1, 101, 201) from the accumulator (4, 104, 204);

wherein the pump (1, 101, 201) and the accumulator (4, 104, 204) are isolated from one another when pressure in the accumulator exceeds a certain value, and the pressure of the pump (1, 101, 201) and/or the pressure of the accumulator (4, 104, 204) is applied to a regulating valve (11, 111, 211) for the purpose of regulating the pump (1, 101, 201);

a connected consuming device isolated from the accumulator (4, 104, 204) such that the load pressure of the consuming device does not affect the accumulator (4, 104, 204);

and wherein the regulating valve (11, 111, 211) has a first position in which the accumulator (4, 104, 204) is connected to a control line with a control line pressure for controlling the pump (1, 101, 201) and a second position in which the control line is discharged into a tank (16, 116, 216).

2. The load valve apparatus of claim 1, characterized in that the regulating valve (11, 111, 211) is tensioned by means of the pressure in the control line, and the area acting on the regulating valve (11, 111, 211) in the discharge direction is smaller than the area acting on it in the opposite direction.

3. The load valve apparatus of claim 1, characterized in that the control valve (3, 103, 203) is controlled by means of the accumulator pressure, which opposed by the force of a spring, and wherein the spring forces the control valve (3, 103, 203) into the first position.

4. The load valve apparatus of claim 3, characterized in that the control valve (3, 103, 203) is additionally controlled by the control line pressure, which assists the spring.

5. The load valve apparatus of claim 1, further comprising a housing which has a port for the pump (1, 101, 201) and a moveable plunger (29) having a circumference, and, when the plunger (29) is in a first position, the fluid can flow from the port through the housing via at least one channel along the circumference of the plunger (29) to a accumulator port, and, when the plunger (29) is in a second position, the connection from the housing to the circumference of the plunger (29) is interrupted.

6. The load valve appratus of claim 5, characterized in that the plunger (29) is forced into the first position by a load imparted by a spring (30) and has a hole which connects the channel to the front side of the plunger (29) located on the opposite side from the spring (30).

7. The load valve apparatus of claim 5, characterized in that the housing has a port for the control line and a control channel which connects the port for the pump (1, 101, 201) to the port for the control line.

8. The load valve apparatus of claim 7, characterized in that the control channel has a restrictor.

9. The load valve apparatus of claim 8, characterized in that the restrictor is embodied as a series of restrictors (26).

10. The load valve apparatus of claim 9, characterized in that the series of restrictors (26) is embodied as four enlarged spaces.

11. A load valve apparatus comprising:

a control valve (3, 103, 203) which is connected to a pump (1, 101, 201) having a pump pressure and an accumulator (4, 104, 204) and which in a first position connects the pump (1, 101, 201) to the accumulator (4, 104, 204) and in a second position separates the pump (1, 101, 201) from the accumulator (4, 104, 204);

wherein the pump (1, 101, 201) and the accumulator (4, 104, 204) are isolated from one another when pressure in the accumulator exceeds a certain value, and the pressure of the pump (1, 101, 201) and/or the pressure of the accumulator (4, 104, 204) is applied to a regulating valve (11, 111, 211) for the purpose of regulating the pump (1, 101, 201);

a connected consuming device isolated from the accumulator (4, 104, 204) such that the load pressure of the consuming device does not affect the accumulator (4, 104, 204); and characterized in that the pump (1, 101, 201) can be connected to a control line, and the regulating valve (11, 111, 211) has a first setting in which the control line is closed off and a second position in which the control line is discharged into a tank (16, 116, 216).

12. The load valve apparatus of claim 11, characterized in that the regulating valve (11, 111, 211) has an intermediate position in which the control line is discharged into the tank (16, 116, 216) via a restrictor, and the control line is connected to the accumulator (4, 104, 204) or the pump (1, 101, 201) via a restrictor.

13. The load valve apparatus of claim 12, characterized in that the regulating valve (11, 111, 211) is tensioned by means of the pressure in the control line, and the area acting on the regulating valve (11, 111, 211) in the discharge direction is smaller than the area acting on it in the opposite direction.

14. The load valve apparatus of claim 1, characterized in that the regulating valve (11, 111, 211) is tensioned by means of the pressure in the control line, and the area impacting on the regulating valve (11, 111, 211) in the discharge direction is smaller than the area acting on it in the opposite direction.

15. A load valve apparatus comprising:

a control valve (3, 103, 203) which is connected to a pump (1, 101, 201) having a pump pressure and an accumulator (4, 104, 204) and which in a first position connects the pump (1, 101, 201) to the accumulator (4, 104, 204) and in a second position separates the pump (1, 101, 201) from the accumulator (4, 104, 204);

wherein the pump (1, 101, 201) and the accumulator (4, 104, 204) are isolated from one another when pressure in the accumulator exceeds a certain value, and the pressure of the pump (1, 101, 201) and/or the pressure of the accumulator (4, 104, 204) is applied to a regulating valve (1, 111, 211) for the purpose of regulating the pump (1, 101, 201);

a connected consuming device isolated from the accumulator (4, 104, 204) such that the load pressure of the consuming device does not affect the accumulator (4, 104, 204); and characterized in that the regulating valve (11, 111, 211) is controlled by means of the accumulator pressure, which is opposed by the force of a spring.

16. A load valve apparatus comprising:

a control valve (3, 103, 203) which is connected to a pump (1, 101, 201) having a pump pressure and an accumu lator (4, 104, 204) and which in a first position connects the pump (1, 101, 201) to the accumulator (4, 104, 204) and in a second position separates the pump (1, 101, 201) from the accumulator (4, 104, 204);

wherein the pump (1, 101, 201) and the accumulator (4, 104, 204) are isolated from one another when pressure in the accumulator exceeds a certain value, and the pressure of the pump (1, 101, 201) and/or the pressure of the accumulator (4, 104, 204) is applied to a regulating valve (11, 111, 211) for the purpose of regulating the pump (1, 101, 201);

a connected consuming device isolated from the accumulator (4, 104, 204) such that the load pressure of the consuming device does not affect the accumulator (4, 104, 204); and characterized in that the pump (1, 101, 201) is controlled via the pressure in a control line, and a supplementary valve is controlled via the pressure in the control line, and when the pressure in the control line drops said supplementary valve is moved to a discharge position such that the line connected to the pump (1, 101, 201) to control the pump is discharged.

* * * * *